US005634189A

United States Patent [19]

Rossmann et al.

[11] Patent Number: 5,634,189

[45] Date of Patent: May 27, 1997

[54] STRUCTURAL COMPONENT MADE OF METAL OR CERAMIC HAVING A SOLID OUTER SHELL AND A POROUS CORE AND ITS METHOD OF MANUFACTURE

[75] Inventors: Axel Rossmann, Karlsfeld; Wilfried Smarsly, Grasbrunn, both of Germany

[73] Assignee: Mtu Motoren-Und Turbinen Union München GmbH, München, Germany

[21] Appl. No.: 339,394

[22] Filed: Nov. 14, 1994

[30] Foreign Application Priority Data

Nov. 11, 1993 [DE] Germany ..... 43 38 457.9

[51] Int. Cl.[6] ..... B22F 7/02

[52] U.S. Cl. ..... 428/547; 428/548; 428/549; 428/550; 428/551; 428/552; 428/553; 428/554; 428/557; 428/558; 428/566

[58] Field of Search ..... 428/548, 550, 428/552, 557, 558, 547, 549, 551, 553, 554, 566; 419/5

[56] References Cited

U.S. PATENT DOCUMENTS

| | | | |
|---|---|---|---|
| 3,781,170 | 12/1973 | Nakao et al. | 29/182.5 |
| 4,144,372 | 3/1979 | Beck | 428/283 |
| 4,357,393 | 11/1982 | Tsuda et al. | 428/547 |
| 4,925,740 | 5/1990 | Norris et al. | 428/547 |
| 5,073,459 | 12/1991 | Smarsly et al. | 428/550 |
| 5,223,213 | 6/1993 | Kamimura et al. | 419/35 |

OTHER PUBLICATIONS

R.C. Laramee, "Materials and Properties Description", in *Engineered Materials Handbook, vol. 1: Composites*, ASM, Ohio, 1987, pp. 355–358.

*Primary Examiner*—Charles T. Jordan
*Assistant Examiner*—Chrisman D. Carroll
*Attorney, Agent, or Firm*—Ladas & Parry

[57] ABSTRACT

A structural component is formed with an outer shell of sintered, solid, powder particles, and a porous core of sintered, hollow, bodies arranged in layers. The hollow bodies are of increased diameter in the layers in a direction from the outer periphery of the core towards the center of the core. The material of the outer shell and of the core is a metal or ceramic.

11 Claims, 4 Drawing Sheets

STRUCTURAL COMPONENT MADE OF METAL OR CERAMIC HAVING A SOLID OUTER SHELL AND A POROUS CORE AND ITS METHOD OF MANUFACTURE

FIELD OF THE INVENTION

The invention relates to a structural component made of metal or ceramic having a solid outer shell and a porous core.

The invention further relates to a method of manufacturing the structural component.

BACKGROUND

Components having a solid outer shell and a porous core are known from the production of plastic materials in which a solid outer skin is produced by heating the surface of a foam plastic composition.

For metallic or ceramic components, porosity in the core is achieved, for example, by sintering different sizes of uniform particles or by incorporating foam metals in a solid outer shell. This has the disadvantage that variations in the porosity and adaptation of the porosity to strength and constructional requirements are extremely limited. Thus, in the past, it has not been possible to obtain a high strength component resistant to large compression forces applied to a thin-walled outer shell with a high porosity core.

SUMMARY OF THE INVENTION

An object of the invention is to provide a structural component of this type and a process for its manufacture, by which the component exhibits a structure which will form a solid, dense, strong, thin-walled outer shell for resisting large stresses and surface compression forces, and an enclosed porous core for providing rigidity for the component.

In accordance with the invention, this object is attained by forming the outer shell of a powder material which has been sintered to produce a solid, dense layer, for resisting high surface compression forces, and forming the core of sintered, hollow bodies which are applied in the form of layers forming spherical or polygonal cavities or pores which increase in size from the periphery of the core towards the center.

A layer of the core can, if required, consist only of a single layer of hollow bodies of the same diameter and the diameters of the bodies can increase successively in steps towards the center of the core such that a gradual transition from a solid, non-porous outer shell to a high porosity in the interior of the porous core is produced. This has the advantage that a high rigidity of the thin-walled outer shell is obtained with minimum weight which is especially advantageous for components in the construction of propulsion units, such as turbine propulsion units, and for components of engines, such as pistons for producing compression in the cylinders of the engine. The compression forces which act on the top of a piston during combustion can be resisted, without problems, by producing the piston with a relatively thin-walled outer shell and a porous core. Stress concentrations which arise in the piston in the vicinity of the bores to receive the wrist pins of the connecting rods can be resisted by providing an appropriate layer arrangement and selection of the diameters of the hollow bodies of the core.

Thus, narrow core cross-sections preferably have smaller cavities than wide core cross-sections. The size of the hollow cavities is defined by the internal diameters of the sintered hollow bodies. The hollow bodies are generally spherical and polygonal hollow cavities are formed if the structural component is compressed isostatically in the hot state during, or after, sintering of the outer shell.

Predominantly spherical hollow cavities are advantageously maintained if the empty spaces between the hollow spherical bodies are filled with a matrix material consisting of particles of a powder of the same chemical composition as the hollow spherical bodies. After sintering, the spaces between the hollow spherical bodies then become filled with sintered matrix material.

In a preferred embodiment of the invention, in addition to the powder which is capable of sintering, fibers are added also between the layers of hollow bodies prior to sintering. This has the advantage that the mechanical strength of the core is increased, especially for resisting tensile stresses. Since rotor blades of propulsion units are subjected to increased tensile stresses, the fiber material is preferably introduced into the empty spaces between the hollow bodies for such applications and they are partially or completely embedded in the matrix material.

The powder material of the outer shell and, if required, the powder material between the hollow bodies and the material of the hollow bodies themselves, preferably consist of metal of metal alloys. For this purpose, preferably used are metal alloys which are difficult to machine, such as highly alloyed steels, cobalt-based alloys, titanium-based alloys or nickel-based alloys.

In a further preferred embodiment of the invention, the powder material and the hollow bodies consist of intermetallic compounds. Components which are made from these alloys excel by virtue of their hardness and their corrosion resistance, but normally they are very difficult to process mechanically and electrochemically. Thus, the structure of such components in accordance with the invention is especially advantageous for these materials.

These advantages apply to a far greater extent to components in which the powder material and the hollow bodies are made from a ceramic material.

In the component in accordance with the invention, the density of the materials can preferably decrease from the outer shell toward the center of the core, namely, from virtually 100% to 3%, and the porosity can increase correspondingly from approximately 0% to 97%. Such values have not been achieved with known components. Using this large, adjustable increase in porosity, high-strength components can be formulated with, at the same time, a minimum weight. For this purpose, the hollow bodies in the core have an internal diameter which increases from the periphery of the core to its interior. The internal diameter of the hollow bodies can vary between 0.01 and 10 mm. A range between 0.3 and 5 mm is used if wider transitions between the layers of hollow bodies are permissible and if, in particular, the empty spaces between the hollow bodies are filled with a fiber material and/or a powder which can be sintered.

A process for the production of a component made from metal or ceramic material with a dense, solid outer shell and a porous core comprises the following steps:

a) providing suspensions with water or alcohol and/or binders in different preparations both with solid particles of different particle sizes and hollow bodies with different diameters;

b) forming an outer shell, as the first layer, from a solid powder, which is capable of being sintered to a high degree, in the form of a suspension; suspensions of smaller particle sizes are preferably used for the formation of a finely porous outer skin and layers of suspensions of particles with sizes which increase toward the interior are used for the formation of the outer shell.

c) forming a porous core from suspensions of hollow spherical bodies in which further layers are applied to the outer shell consisting of suspensions of hollow spherical bodies whose diameters increase towards the interior;

d) burning off solvents and binders and sintering the layers of suspensions completely or partially in the mold to obtain the structural component.

After formulating the different suspension preparations, these are stored separately up to the time of use for respective ones of the layers which are to be formed. In this connection, the suspension preparations are prepared in the form of casting compositions in order to be able to be introduced into the mold as a coatable composition, which, for example, dries in the air, by pouring, spraying or brushing onto a surface of the mold that provides the underlying shape. Alternatively, the suspension can be thickened to a paste-like consistency for application by a trowel or spatula onto the surface. The mold in which the various suspensions are deposited is enlarged in steps to accommodate the respective successive layers of suspension composition which change from layer to layer.

In a preferred embodiment of the process, different suspension preparations for the outer shell, consisting of solid particles, and the porous core, consisting of hollow bodies are introduced one after another into the mold by pouring the suspensions into an opening in the mold. After the application of the first layer of suspension onto the internal surface of the mold, the remaining suspension preparations are applied via the opening by pouring in the materials. The opening for pouring in the materials is then finally sealed with a sequence of different suspension layers. This has the advantage that components of complex shape with an external shell assembly and core assembly in accordance with the invention are capable of being prepared in the simplest possible way. In the case of components, such as turbine blades, as shown in FIG. 2, sealing of the pouring opening can even be omitted if the tip of the turbine blade is constructed with an opening that can be utilized for introduction of the suspension.

In a further preferred embodiment of the process, the outer shell is prepared in two separate steps from an internal shell portion and an external shell portion. For this purpose, a first layer of the internal shell is initially deposited in the mold using a uniform powder which is capable of being sintered to a high degree. The powder is in a suspension of small particle size to form an outer skin of the internal shell with very fine pores. Thereby, suspension layers with particle sizes which increase toward the interior of the internal shell are used for the formation of the interior of the internal shell. A porous core is then produced from suspensions of hollow spherical bodies which first increase in diameter in successive layers and then decrease in diameter in successive layers. Finally, the external shell of the component is produced by means of suspensions of small particle sizes for the formation of a solid, non-porous outer skin of the external shell and suspension layers of particle sizes which increase toward the interior are used for the formation of the remainder of the external shell to provide a porosity which increases toward the interior.

The variation has the advantage that it is especially capable of being used for hollow components, such as cylinders, tanks, housings, pistons, and the like.

In regard to a further preferred embodiment, the suspension preparations are prepared in the form of casting compositions for pouring into a centrifugal mold. The different layers of the suspensions for an external outer shell, a porous core consisting of hollow spherical bodies and an internal outer shell are then formed by means of centrifugal casting in the centrifugal mold which advantageously permits very accurate gradation of the sequential order of the layers which are to be applied.

In a further preferred embodiment, suspension preparations are produced in the form of compositions which can be sprayed or compositions which can be applied by a brush or compositions which can be applied by means of a trowel or spatula. The different layers of suspension for the internal outer shell, the porous core and the external outer shell are then applied to a base, support surface by brushing, spraying or application by a spatula. This advantageously permits the preparation, on a surface of complex shape, of components in accordance with the invention.

In the preparation of components with internal cavities and of complex shape according to the invention, a suspension of a fine powder for a solid internal outer shell of the component is initially coated on a basic mold or internal mold and suspensions with increased particle size are applied successively to form layers in which the average particle size increases from layer to layer. Thereafter, suspensions of hollow, spherical bodies are applied in which the diameters of the hollow, spherical bodies increase from layer to layer until the center of the porous core has been reached. Then, the diameters of the hollow spherical bodies are progressively reduced in the successive layers and, finally, layers with solid particles are then applied with decreasing average particle sizes so that an external outer shell of the component is produced and the component reaches its final shape using the finest powder layers.

Between the introduction of each suspension layer, escape of the solvents preferably takes place so that the molded object is self-supporting and can be subjected to heating to remove binders and/or for sintering with or without support by the suspension mold or the shape-providing surface.

The sintering step is preferably carried out under pressure, in a press, at the softening temperature of the hollow spherical bodies in order to form polygonal hollow cavities or pores. As a result, a lightweight component is advantageously formed with systematically arranged closed pores which can be exposed to surface stresses since the material between the pores has been sintered in an extremely compact manner. Moreover, because of the gradual increase in the pore volume toward the center of the core, a level of rigidity is obtained which is not capable of being achieved with conventional structures which consist of uniform materials.

The burning off of the binders and/or the sintering step can preferably take place directly after each application of a layer of suspension. Although, in this case, the number of heating steps and/or sintering steps increases considerably, an extremely precisely configured internal structure of the core and thereby of the component, is achieved.

If high resistance to microscopic tears, corrosion and erosion is required then the sintered outer shell of the component (which has been prepared from a solid, particulate material) can preferably be post-compacted by infiltration or by the application and inward diffusion of a material which is capable of sintering.

In a preferred embodiment, the solid particles and the hollow bodies in the suspension preparations consist in part of the metallic components of intermetallic compounds. In this respect, a stoichiometric relationship between the metallic components is obtained by maintaining appropriate ratios, by weight, during the formulation of the spherical bodies and the powder particles. During the subsequent sintering step, the necessary reaction temperature for the formation of intermetallic compounds is then maintained so that, advantageously, the entire component consists of an intermetallic compound after the sintering process. This cannot be achieved with forging and stress-relief processing operations because of the hardness and brittleness of the intermetallic compounds.

The duration and temperature of the sintering step must be adapted to the material of the uniform particles, which are capable of being sintered, and to the hollow bodies of the casting suspensions. In a preferred material interchange between the individual suspension layers, it may therefore be necessary to carry out the burning off and/or sintering operation after application of each layer of suspension and, moreover, each burning off and/or sintering step has to be carried out at temperatures which are differently adapted for correspondingly adapted periods of time.

An especially preferred process during sintering is hot isostatic compression. For this purpose, the component is encapsulated in a freshly cast object or in its suspension mold before it is exposed to the high pressures of an isostatic press. During such hot isostatic compression, the hollow spherical bodies become deformed to produce polygonal structures whereby the walls of the hollow spherical bodies sinter together to produce a compact structural mass.

DETAILED DESCRIPTION OF PREFERRED EMBODIMENTS

Figure 1:
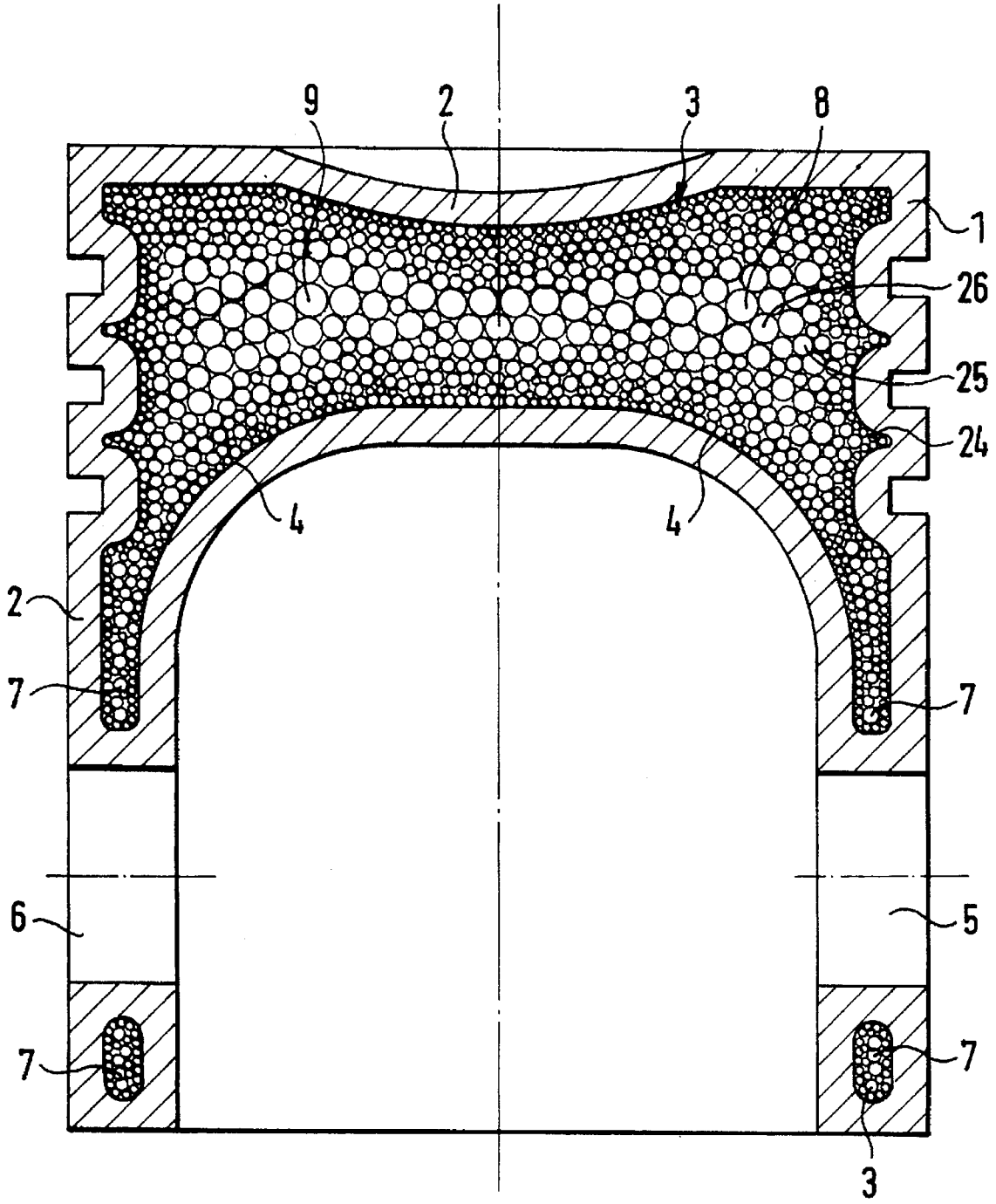
FIG. 1 is a cross-section through a piston of a combustion engine constructed according to the invention.

FIG. 1 is a cross-section through a piston 1 of a combustion engine. The piston 1 consists of a metal alloy. The piston has a solid, outer shell 2 which consists of a powder material which has been compactly sintered and is formed by several layers of suspension casting material. An outermost layer of the outer shell was prepared from a powder material consisting of extremely fine particles of less than 10 μm average diameter. Layers of cast suspension material follow toward the interior which consist of powders of increasing uniform particle sizes which have an average particle diameter of up to 500 μm.

A porous core 3 adjoins the outer shell 2. The core 3 consists of sintered hollow bodies which are arranged in layers and form spherical or polygonal, hollow cavities of a size which increases toward the center of the core. The hollow bodies of the core, are capable of being sintered and are applied in successive layers as casting suspensions, the outermost layer of the core adjoining the inner surface of shell 2 incorporating hollow bodies of the smallest diameter and the hollow bodies reach a maximum diameter as shown by bodies 8, 9 at the center of the core.

Depending on the surface stress applied to the outer shell 2, use is made of hollow bodies of smaller diameters (for a high surface stress) or hollow bodies of larger diameters (for small surface stresses). Thus, for example, in the region of bores 5, 6 in the piston for receiving the wrist pins of a connection rod, where the stresses are high and the piston thickness is small, the core has a small cross-section as shown at numeral 7 and it is filled with hollow bodies of relatively small diameter, in order for the piston to be able to resist the high stress hereat. The regions 8, 9 in the piston of large volume are, in contrast, furnished with larger diameter, hollow bodies since the stress hereat is correspondingly lower.

In terms of weight and strength, the structures of the core 3 and of the outer shell 2 are thus capable of accurate adaptation to the applied forces and each region which is subjected to low stress can be furnished with correspondingly larger diameter hollow bodies and consequent higher porosity in the material.

Figure 2A:
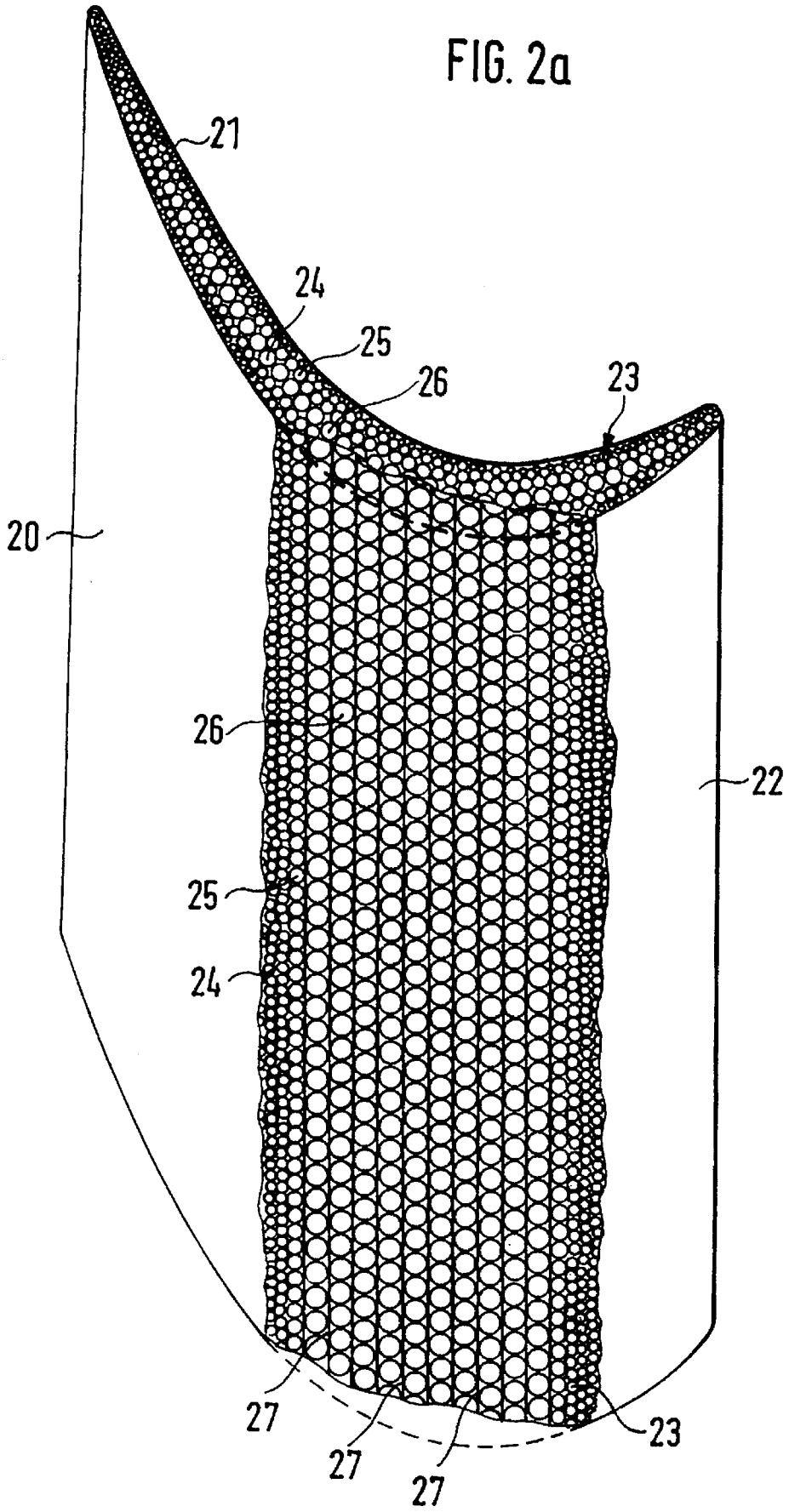
FIG. 2*a* is a perspective view of a turbine blade, partly broken away and in section, according to the invention.

FIG. 2*a* shows a section of a turbine blade 20 which consists of a metal or ceramic material with a solid, outer shell 21 and a porous core 23. The outer shell 21 is formed from solid sintered powder material and the core 23 consists of sintered hollow spherical bodies 24, 25 and 26 of different diameter. The hollow bodies 24, 25 and 26 are arranged in layers and form spherical or polygonal hollow cavities which become larger towards the center of the core. The sintered hollow bodies 24, 25 and 26 support the relatively thin outer shell 21 (of 100 μm thickness) so that high surface compression forces applied to the outer shell 21 can be resisted. The tensile strength of the turbine blade 22 is increased by incorporating fibers 27 in a matrix material between the hollow bodies. The fibers extend in the direction of the tensile stress. Fine, uniform powder material which is capable of being sintered is used as the matrix material and the uniform powder material corresponds to the hollow bodies in terms of chemical composition or it improves the material thereof in terms of its ability to be sintered.

As far as the fiber materials are concerned, silicon carbide fibers or carbon fibers are preferably used in the case of metallic, hollow bodies and a metallic matrix material. In the case of turbine blades which are made of a ceramic material, metallic fibers are preferably incorporated between the hollow bodies in the chemically similar matrix material so that the high tensile strength of the metal fibers is supplemented by the high temperature resistance of the ceramic material.

As a result of anchoring the fibers 27 in a foot of the turbine blade, high-strength, temperature-resistant turbine blades can advantageously be produced of lightweight construction.

Figure 2B:
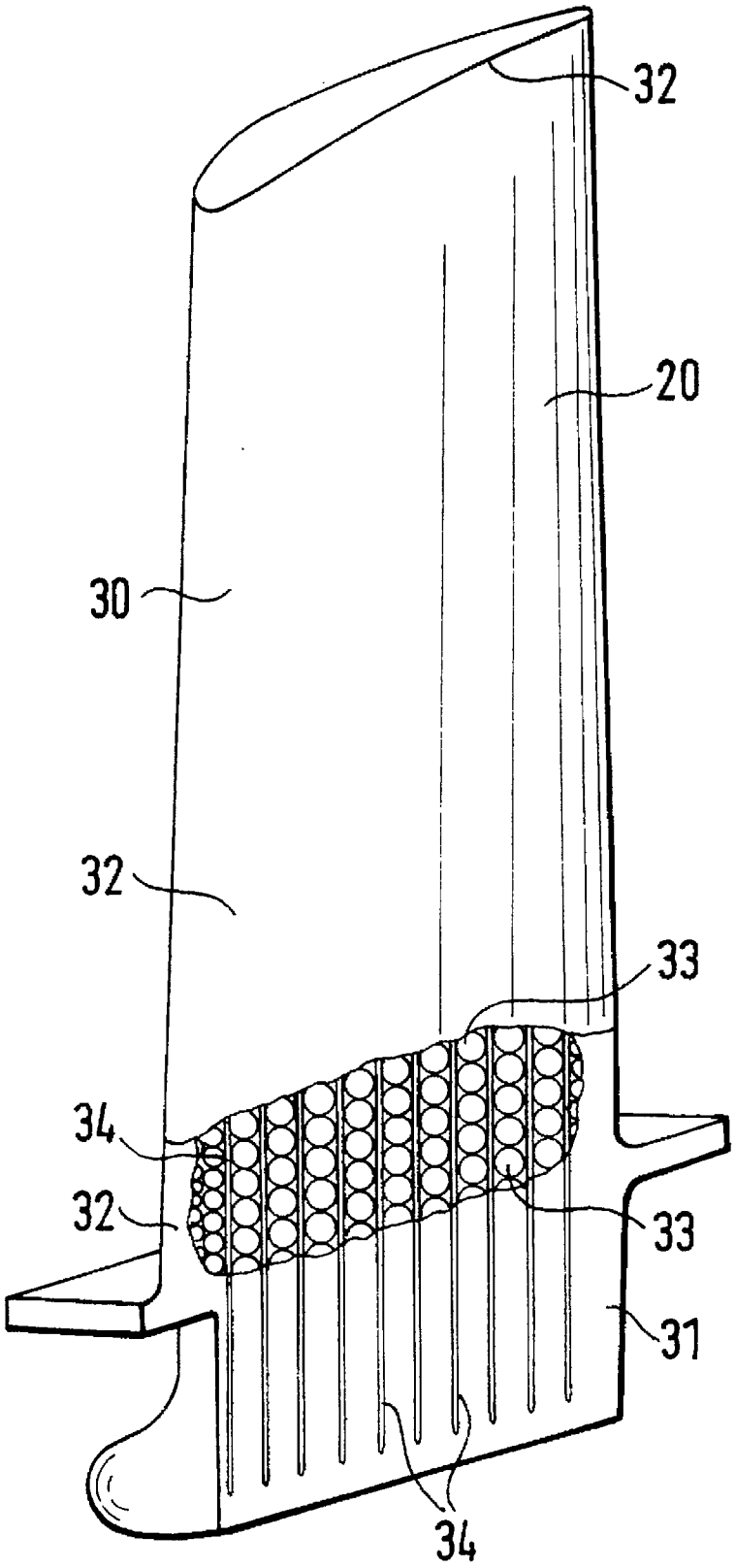
FIG. 2*b* shows another arrangement of a turbine blade according to the invention.

FIG. 2*b* shows turbine blade 20 with a blade portion 30 and a foot 31. The turbine blade consists of a sintered, outer shell 32 of only about 10 μm thickness. The outer shell 32 is supported by a core which consists of sintered, hollow bodies 33 so that high surface compression can act on the outer shell 32. In addition, the core incorporates fibers 34 passing through the sintered core of hollow bodies in the direction of highest tensile stress and the fibers are anchored in the foot 31 which is made of uniform, sintered, solid, powder material.

Figure 3:
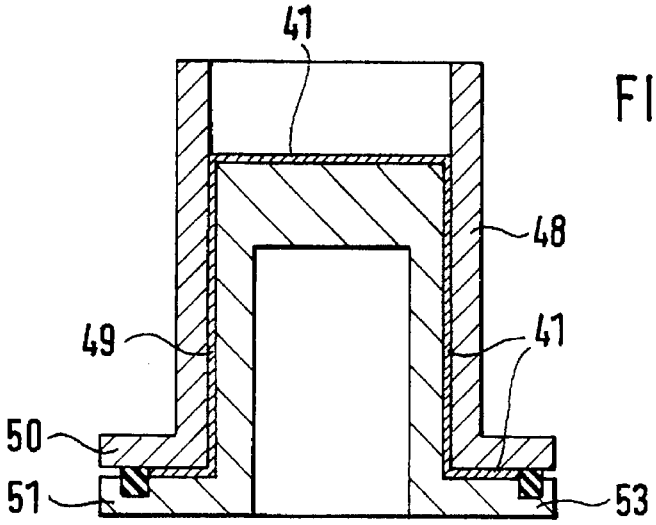
FIGS. 3, 4 and 5 are cross-sectional views illustrating the successive stages of production of components suitable for use in the embodiments in FIGS. 1, 2*a* and 2*b*.
Figure 4:
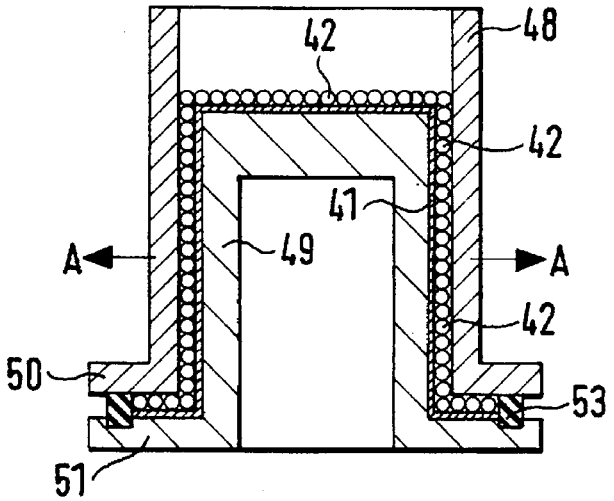
Figure 5:
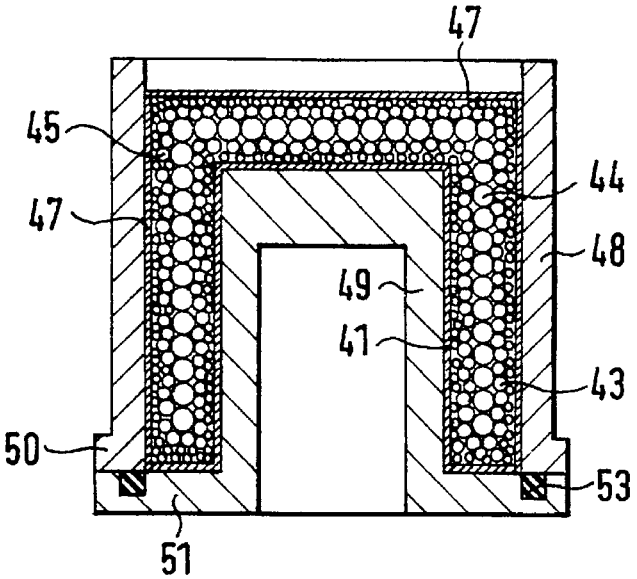

FIGS. 3–5 show the procedural steps for the preparation of the components in FIGS. 1 and 2. For this purpose, several suspension preparations are initially produced with water or alcohol and/or binders which are soluble therein of solid powders of different particle sizes and hollow spherical bodies of different diameter. As shown in FIG. 3, an internal outer shell 41 is applied in a suspension mold as a first layer of a solid powder which is capable of being sintered to a high degree. For this purpose, suspensions can be used, one after the other, with small size particles for the formation of an outer skin with very tine pores and suspension layers of particle sizes which increase toward the interior for the formation of the remainder of the outer shell.

The suspension mold is made of two parts consisting of an external cylinder 48 and an internal cylinder 49 which remains unchanged during the introduction of the various suspension preparations into the intermediate space between the internal cylinder and the external cylinder for the formation of the various suspension layers. The external cylinder in contrast, is changed for each suspension layer so that the internal diameter of the external cylinder is increased one step in the direction of the arrows A in FIG. 4 for each applied layer. As a result, both the powder particles for the outer shell 41 and the hollow bodies for the internal core can increase in diameter in each successive layer.

In this embodiment, the external cylinder and the internal cylinder have flanges 50, 51 at their lower ends between which an annular seal 53 is arranged. The annular seal 53 seals the intermediate space between the two flanges of the internal and the external cylinders. The external cylinder can be made from a semi-permeable material which advantageously promotes the rapid drying of the layer of suspension without the layer of the suspension becoming less concentrated with respect to the solid particles or hollow bodies.

The internal outer shell 41 has two layers of suspension applied thereto respectively comprising an outer layer of suspension of solid particles with an average particle diameter between 10 and 30 μm and an inner layer of suspension of solid particles with an average particle diameter between 30 and 100 μm. The two layers of the external outer shell is formed by using two external cylinders of different diameter. Then, the first layer of suspension of the core material is applied. For this purpose, the second external cylinder is replaced by a third external cylinder of correspondingly larger internal diameter and the intermediate space between the internal outer shell 41 and the outer cylinder is filled with a suspension preparation of hollow bodies with an average diameter of 100 to 150 μm to form the first suspension layer of hollow bodies 42.

Subsequent layers of suspensions of hollow bodies 43, 44 with increasing average diameters of the hollow bodies are applied as shown in FIG. 5. The layer of the suspension of hollow bodies 43 has an average diameter of 1 to 1.5 mm and the layer of the suspension of hollow bodies 44 has a diameter of 3 to 5 mm.

The layers are then incorporated in reverse sequence with decreasing diameters of the hollow bodies and decreasing diameters of the solid particles until the external outer shell 47 has been formed and a pot-shaped component has been prepared in the form of a green casting. The pot-shaped green casting is now heated and the particles and hollow bodies are sintered to produce a lightweight component resistant to high surface compression. For components consisting of iron-nickel alloys, heating takes place at 450° C. for 5 hours under vacuum and sintering takes place for 15 minutes at 1350° C. under vacuum.

By providing a more complex shape for the suspension mold, the components shown in FIGS. 1 and 2 can be made using this process. In this manner, accordingly, the process can be modified such that, between the cast layers of the suspension, fibers are incorporated in order to strengthen the component. The empty spaces between the hollow bodies can be filled with a matrix material using solid particulate materials which are added to the suspension of the hollow bodies. As a result of hot, isostatic compression of the green casting, it is also possible to close the empty spaces between the hollow bodies without the separate addition of solid particles. As a result, polygonal, hollow cavities or pores are produced in the core region of the component with a minimum weight of the component. In regard to components which consist of iron-nickel alloys, hot isostatic compression takes place at a temperature of 1350° C. under a pressure of 1 MP for 1 hour in an inert gas atmosphere, for example, argon.

Further advantageous applications of this process are the preparation of machine parts for engine components and propulsion unit components, such as gear wheels, rotor disks, housings, pressure valves, nozzle walls and engine valves. In addition to ceramic materials and fiber-strengthened, ceramic materials, the materials which are to be processed for these components are preferably iron-based alloys, titanium-based alloys, cobalt-based alloys or nickel-based alloys.

What is claimed is:

1. A structural component comprising an outer shell including external and internal shell portions spaced from one another in generally parallel relation, and a core within a space formed between said external and internal shell portions, said internal and external shell portions each being constituted of sintered, solid, powder particles, said core comprising sintered, hollow, bodies arranged in juxtaposed layers one on the next in approximately parallel relation between said internal and external shell portions, said hollow bodies having graduated increased diameters in said layers in a direction from an outer peripheral region of the core at said internal and external shell portions towards a center of the core, said hollow bodies in each of said layers being substantially of the same diameter and disposed in the respective layer approximately parallel to said internal and external shell portions.

2. A structural component as claimed in claim 1, wherein the material of the particles of the external and internal shell portions and of the hollow bodies of the core is metal or ceramic.

3. A structural component as claimed in claim 2, wherein the hollow bodies of the core are substantially spherical.

4. A structural component as claimed in claim 2, having regions of relatively narrow and wide cross-sections, said core in said region of narrow cross-section occupying a proportionately smaller cross-sectional area in said component compared to the cross-sectional area it occupies in said component in said region of wide cross-section.

5. A structural component as claimed in claim 2, wherein hollow spaces are formed between the hollow bodies in said core, said component further comprising a matrix material filling said hollow spaces.

6. A structural component as claimed in claim 5, wherein said matrix material is a sintered material.

7. A structural component as claimed in claim 5, comprising reinforcing fibers in said core embedded in said matrix material.

8. A structural component as claimed in claim 1, wherein the material of said internal and external shell portions and of said hollow bodies is an intermetallic compound.

9. A structural component as claimed in claim 1, wherein the particles forming the material of said internal and external shell portions have a compaction density which varies from substantially 100% at an outer surface of the respective shell portion to a compaction density at the center of the core of about 3%, said component thereby having a porosity which varies from about 0% at said outer surface of the shell portions to about 97% at the center of said core.

10. A structural component as claimed in claim 9, wherein the diameter of the hollow bodies of the core varies from about 0.3 mm in the outermost layers thereof juxtaposed with said internal and external shell portions to about 10 mm at the center of the core.

11. A structural component as claimed in claim 9, wherein the diameter of the hollow bodies of the core varies from about 0.3 mm in the outermost layers thereof juxtaposed with said internal and external shell portions to about 5 mm at the center of the core.

* * * * *